US005495655A

United States Patent [19]

Morioka

[11] Patent Number: 5,495,655

[45] Date of Patent: Mar. 5, 1996

[54] METHOD AND APPARATUS FOR FORMING SLIDE-FASTENER COUPLING ELEMENT

[75] Inventor: Koitsu Morioka, Toyama, Japan

[73] Assignee: Yoshida Kogyo K.K., Tokyo, Japan

[21] Appl. No.: 263,375

[22] Filed: Jun. 21, 1994

[30] Foreign Application Priority Data

Jun. 22, 1993 [JP] Japan ..... 5-150614

[51] Int. Cl.[6] ..... B21D 53/52

[52] U.S. Cl. ..... 29/410; 29/766; 29/769; 29/34 A; 83/921

[58] Field of Search ..... 29/410, 766, 769, 29/34 A; 83/921

[56] References Cited

U.S. PATENT DOCUMENTS 4,432,126 2/1984 Sugahara .

FOREIGN PATENT DOCUMENTS 63-11094 3/1988 Japan .

*Primary Examiner*—P. W. Echols

*Attorney, Agent, or Firm*—Hill, Steadman & Simpson

[57] ABSTRACT

A method and apparatus for forming a slide-fastener coupling element from a metal wire having a substantially Y-shaped cross section wherein a blank piece is cut or sliced off from the metal wire by a co-action between a cutoff die and a cutoff punch, and substantially at the same time, the metal wire is chamfered along a next cutting line by a chamfering edge so as to form a substantially V-shaped groove extending in and along the peripheral surface of a head portion of the metal wire and the outside surface of each of two opposed leg portion of the metal wire. The next slicing operation produces a blank piece which is already chamfered at its upper and lower peripheral edges extending along the peripheral surface of the head portion and the outside surfaces of respective leg portions of the blank piece. A finished coupling element shaped from the thus chamfered blank piece is smooth to touch and ensures smooth sliding movement of a slider which will guarantee smooth opening and closing operation of a slide fastener.

3 Claims, 3 Drawing Sheets

METHOD AND APPARATUS FOR FORMING SLIDE-FASTENER COUPLING ELEMENT

BACKGROUND OF THE INVENTION

1. Field of the Invention

The present invention relates generally to a method of and an apparatus for successively forming slide-fastener coupling elements by transversely cutting or slicing a continuous metal wire having a substantially Y-shaped cross section. More particularly, this invention concertos such a slide-fastener coupling element forming method and apparatus in which simultaneously with the cutting, a cut edge of the metal wire is chamfered.

2. Description of the Prior Art

In the manufacture of a slide-fastener coupling element of the type concerned, a metal wire that has been preformed into a Y profile in transverse cross section is fed intermittently. While the metal wire is at rest, a cutoff punch and a cutoff die are relatively moved to cut or slice the metal wire into a succession of blank pieces each having an individual product thickness. Subsequently, the head portion of each of the sliced blank pieces is shaped by a pocket-forming punch and a head-forming die into a coupling head having, on its opposite sides, a protrusion and a corresponding pocket. Thus, each blank piece is shaped into a finished coupling element. The finished coupling elements thus produced are collected and after an additional finishing process, such as polishing or plating, they are attached by clinching to a fastener tape along one longitudinal edge thereof. Alternatively, the attachment of the finished coupling elements to the fastener tape may be achieved immediately after the head-forming process described above.

In general, the sharp edges on the press-formed, metal, slide-fastener coupling elements may scratch the user's finger and tend to hinder smooth movement of a slider in the fastener opening and closing directions. To avoid these difficulties, one prior attempt to smooth down the edges of the slide-fastener coupling elements has involved the barrel polishing of the finished coupling elements. According to other prior attempts disclosed in U.S. Pat. No. 3,720,086, edges of the finished coupling elements are partially blunted after the coupling elements are attached to a fastener tape. The blunting process disclosed in the above-mentioned patent publications requires a separate apparatus used exclusively for the blunting purpose and, hence, the whole coupling-element manufacturing system is rendered complicated in construction and the preduction cost of the coupling elements is increased. The prior blunting operation may create flushes on cut end surfaces of the individual coupling elements. Furthermore, since the prior blunting operation is effected only on the leg portions of the coupling elements, the sharp edges on the coupling heads of the respective coupling elements still remain unblunted. With the prior blunting process thus achieved, the coupling elements cannot be smoothly engaged nor disengaged by a slider.

To overcome the foregoing difficulties, the present assignee (i.e. applicant) has proposed an improved method, such as disclosed in Japanese Patent Publication No. 63-11094 (U.S. Pat. No. 4,432,126), wherein a chamfering blade is formed integrally with a cutoff punch at a portion spaced from a cutting edge of the cutoff punch. A metal wire having a substantially Y-shaped cross section is fed intermittently, and while the metal wire is at rest, the cutoff punch and a cutoff die are relatively moved to cut off a blank piece of an individual product thickness from the Y-shaped metal wire. Simultaneous with the cutting, the chamfering blade forms a notch or indent extending in a part of the head portion of the Y-shaped metal wire along the next cutting line of the Y-shaped metal wire. When the next blank piece is sliced off from the metal wire, the edge of a head portion of the thus sliced blank piece is partly chamfered.

The chamfering process disclosed in Japanese Patent Publication No. 63-11094 (U.S. Pat. No. 4,432,126) is effected only at a portion of the peripheral edge of a coupling head of the finished coupling element. The thus chamfered coupling element is successful, as compared with the conventional coupling element having sharp or unchamfered edges, when used in the so-called two-way slide fastener which can be opened and closed in the forward direction or in the reverse direction by a pair of sliders mounted in either face-to-face or tail-to-tail confrontation. However, the coupling elements having such partly chamfered coupling heads are still unsatisfactory to guarantee smooth sliding movement of the sliders.

As is well known in the art, while the slider is moving along a pair of rows of coupling elements, both the coupling head and the legs of each coupling element, and more particularly the peripheral edges at a front end of the coupling head and the outer peripheral edges adjacent to an open end of the legs are brought into sliding contact with the slider. This means that if both of the peripheral edges of the coupling head and the outer peripheral edge of the legs are chamfered, the resulting coupling element will guarantee smooth sliding movement of the slider and provide a smooth touch.

SUMMARY OF THE INVENTION

It is accordingly a general object of the present invention to provide a method and apparatus which can overcome the problems associated with the prior art disclosed in Japanese Patent Publication No. 63-11094.

A more specific object of the invention is to provide a method and apparatus which are capable of forming a press-formed slide-fastener coupling element whose coupling head and legs are appropriately chamfered to guarantee smooth sliding movement of a slider and provide smooth touch.

In one aspect the present invention provides a method of forming a slide-fastener coupling element, of the type in which a continuous metal wire having a substantially Y-shaped cross section including a head portion and a pair of leg portions is intermittently fed in a vertically upward direction through a cutoff die at a predetermined pitch, then the metal wire is cut into a blank piece of an individual product thickness by a co-action between a cutting edge formed at a rear end of the cutoff die reciprocally movable by a ram and a cutting edge of a fixed cutoff punch relatively slidable on the reciprocating cutoff die, and thereafter a head portion of the blank piece is shaped into a coupling head by a co-action between a head-forming die attached to a front end of the cutoff die and a pocket-forming punch disposed above a head-forming position and vertically reciprocally movable toward and away from the head-forming die in synchronism with the reciprocating movement of the head-forming die, wherein the improvement comprises: substantially at the same time one blank piece is cut off from the metal wire, chamfering the metal wire along a next cutting line to form a substantially V-shaped groove extending in and along the peripheral surface of the head portion and the outside surface of each of the leg portions of the metal wire.

The chamfering of the metal wire preferably includes forcing the metal wire against a chamfering edge of the cutoff punch via the reciprocating movement of the cutoff die, the chamfering edge being vertically and downwardly spaced from the top surface of the cutoff die by a distance equal to the thickness of the sliced blank piece, the chamfering edge having a substantially equilateral triangular cross section and being complementary in shape with the contour of a corresponding portion of the metal wire defined by the peripheral surface of the head portion and the outside surface of each of the leg portion of the metal wire and a contour defined inside the chamfering edge is slightly smaller in size than the contour of the metal wire.

In another aspect the invention provides an apparatus for forming a slide-fastener coupling element having a coupling head and a pair of legs, of the type including means for intermittently feeding a continuous metal wire having a substantially Y-shaped cross section including a head portion and a pair of leg portions in a vertically upward direction at a predetermined pitch, a horizontally reciprocating ram, a cutoff die having a vertically guide groove for the passage therethrough of the metal wire and driven by the ram to reciprocate across the pass of movement of the metal wire, a head-forming die attached to a front end of the cutoff die, a fixed cutoff punch having a cutting edge formed at a front end thereof and relatively slidable on a top surface of the cutoff die to cut off a blank piece from the metal wire, and a pocket-forming punch disposed on a head-forming position and vertically reciprocatory movable in synchronism with the reciprocating movement of the head-forming die so as so shape a head portion of the sliced blank piece into a coupling head of a finished coupling element, wherein the improvement comprises: a chamfering blade provided on the cutoff punch and having a chamfering edge horizontally and rearward spaced from the cutting edge of the cutoff punch, the chamfering edge being vertically and downwardly spaced from the top surface of the cutoff die a distance equal to the thickness of the sliced blank piece, the chamfering edge having a substantially equilateral triangular cross section and being complementary in shape with the contour of a corresponding portion of the metal wire defined by the peripheral surface of the head portion and the outside surface of each of the leg portion of the metal wire and a contour defined inside the chamfering edge is slightly smaller in size than the contour of the metal wire.

According to the invention, when the ram moves from its fully advanced position to its fully retracted position, the cutoff die which is attached to the ram is transferred from its fully advanced position to its fully retracted position. Relative to the movement of the cutoff die, the fixed cutoff die apparently moves from its fully retracted position to its fully advanced position, during which time the cutting edge of the cutoff punch and the cutting edge of the cutoff die cross together so that a blank piece having an individual product thickness is cut or sliced off from the metal wire. Substantially at the same time, the retracting movement of the cutoff die forces the metal wire against the chamfering edge on cutoff punch. In this instance, since the chamfering edge extends along a next cutting line which is downwardly spaced from the top surface of the cutoff die by a distance equal to the thickness of the blank piece, and since the chamfering edge is complementary in shape with the contour of the corresponding portion of the metal wire defined by the peripheral surface of the head portion and the outside surface of each of the leg portion of the metal wire and the contour inside of the chamfering edge is slightly smaller in size than the contour of the metal wire, the chamfering edge gradually bites into the outer peripheral surface of the metal surface and eventually forms a substantially V-shaped groove extending in the whole of the outer peripheral surface of the metal wire except rear end surfaces of the respective leg portions.

When the ram arrives at its fully retracted position, the sliced blank piece while held in the cutting edge of the cutoff punch is delivered into a head-forming cavity in the head-forming die. Then, the pocket-forming punch and the presser pad descend to press or stamp the head portion of the blank piece while holding the leg portions against movement. The head portion thus stamped is shaped into a coupling head of a finished coupling element.

The finished coupling element is already chamfered or beveled at its upper and lower outer peripheral edges extending along the peripheral surface of the coupling head and the outside surfaces of the respective legs except at the edges on the rear end surfaces of the legs. The coupling elements thus chamfered are smooth to touch and insures smooth sliding movement of the slider, thereby facilitating smooth opening and closing operation of the slide fastener.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

A preferred embodiment of the present invention will be described below in greater detail with reference to the accompanying drawings.

As previously noted, the present invention is directed to the production of a press-formed slide-fastener coupling element which is formed by cutting or slicing off a blank piece of an individual product thickness from a continuous metal wire having a substantially Y-shaped cross section and subsequently shaping a head portion of the sliced blank piece into a coupling head having, on its opposite sides, a protrusion and a corresponding pocket. As will become clear from the description given below, an important feature of the present invention resides in that simultaneously with the slicing of the blank piece from the Y-shaped metal wire, the peripheral surface of a head portion and the outside surface of each of a pair of leg portions of the Y-shaped metal wire are chamfered or grooved along a line of cutting where the Y-shaped metal wire is cut in the slicing step in the next cycle. Excepting means for carrying out the chamfering, the construction of the invention is substantially the same as that of the prior art. Accordingly, the description given below is mainly directed to the chamfering means which constitutes the important feature of the present invention.

In the illustrated embodiment, the invention is applied to an apparatus of the type disclosed in Japanese Patent Publication No. 63-11094 (U.S. Pat. No. 4,432,126) for producing a slide-fastener coupling element and subsequently attaching the produced slide-fastener coupling element to a fastener tape. The invention is not limited to the illustrated apparatus, but may be embodied in a different type of apparatus in which individual finished coupling elements are collected without being successively attached to a fastener tape. It is to be noted that the invention is applicable to an apparatus including a different shaping mechanism than as disclosed in the last-mentioned Japanese publication, provided that the coupling element is shaped from a metal wire.

Figure 1:
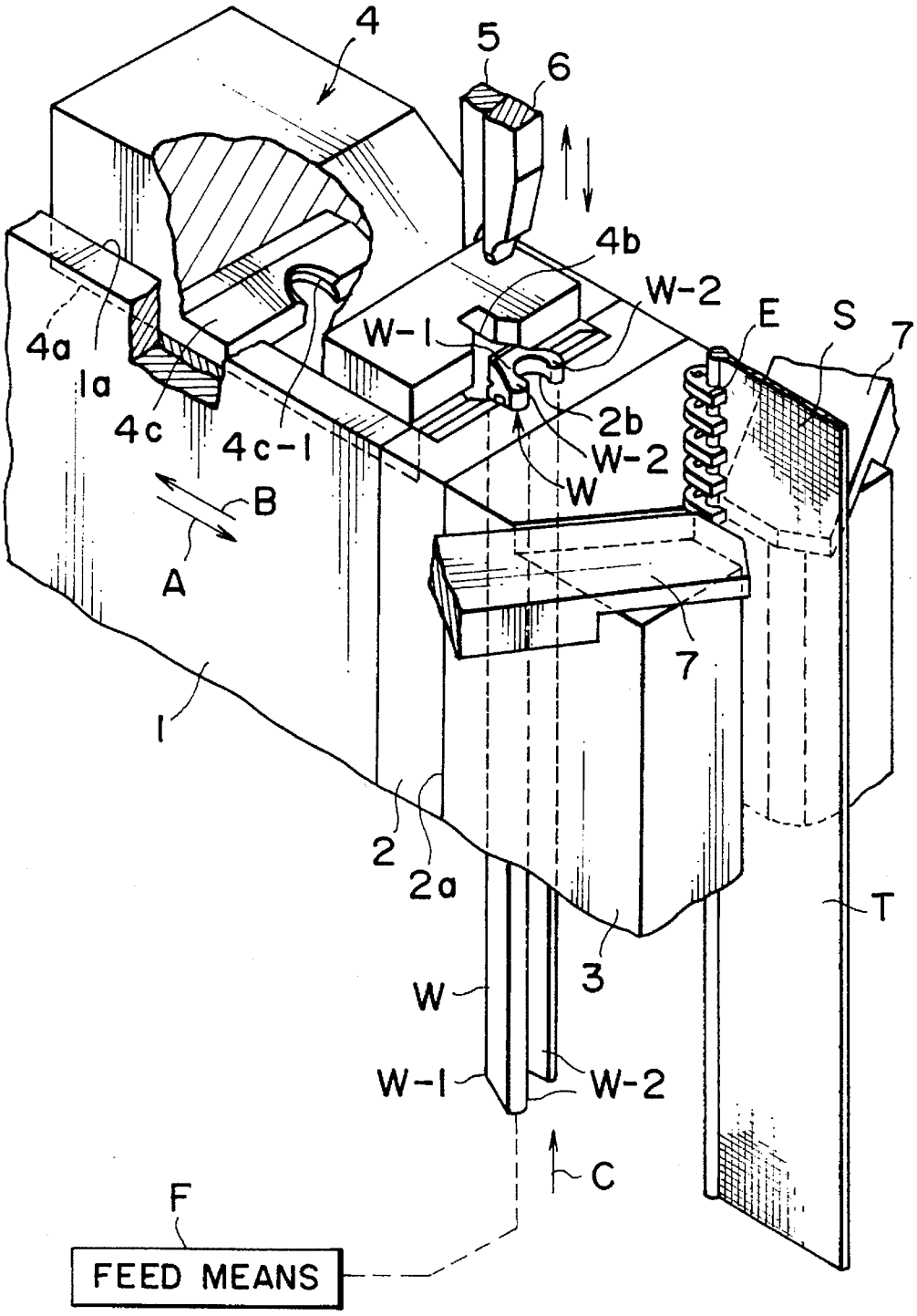
FIG. 1 is a perspective view, with parts cutaway for clarity, of a main portion of an apparatus for making a slide-fastener coupling element according to the present invention.

FIG. 1 shows in perspective a main portion of an apparatus for producing a slide-fastener coupling element according to the present invention. The apparatus includes a ram 1 mounted on a frame (not shown) of the apparatus. The ram 1 is horizontally and slidably supported on a ram guide (not shown) and reciprocates in the directions indicated by the arrows A and B. The direction of the arrow A shown in FIG. 1 is hereinafter referred to as "forward direction", while the direction of the arrow B as "backward direction". A cutoff die 2 is attached to a front end face of the ram 1.

The ram 1 has a recessed guide portion la formed centrally in a top surface thereof and extending along the direction of movement of the ram 1 for slidably receiving and guiding a cutoff punch 4 described later. The cutoff die 2 has a vertical wire guide groove 2*a* extending along a central portion of a rear end face of the cutoff die 2 across the height of the cutoff die 2. The wire guide groove 2*a* and the front end face of the ram 1 jointly form a vertical wire guide hole (not designated) in which a metal wire W is inserted and the metal wire W has been preformed into a Y profile including a substantially rectangular head portion W-1 and a pair of somewhat diverging leg portions W-2, W-2. The metal wire W is intermittently fed by a suitable feed means F, such as a cooperating pair of feed rollers, in a vertically upward direction indicated by the arrow C at a predetermined pitch equal to a thickness of a finished coupling element E. The cutoff die 2 has a cutting edge 2*b* formed by an upper end edge of the wire guide groove 2*a*. The cutoff die 2 has a front end face attached to the rear end face of a head-forming die 3. The head-forming die 3 has a head-forming recess or cavity 3*a* (FIGS. 2–4) which is aligned with the cutting edge 2*b* in the direction of movement of the ram 1.

Figure 2:
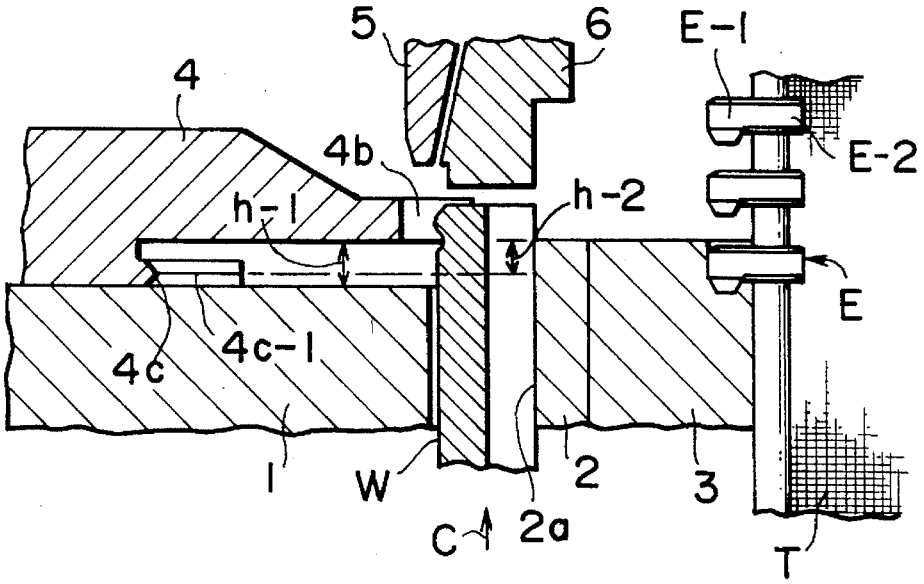
FIG. 2 is a vertical cross-sectional view showing the positional relationship between essential components of the apparatus when a ram is in its fully advanced position.
Figure 3:
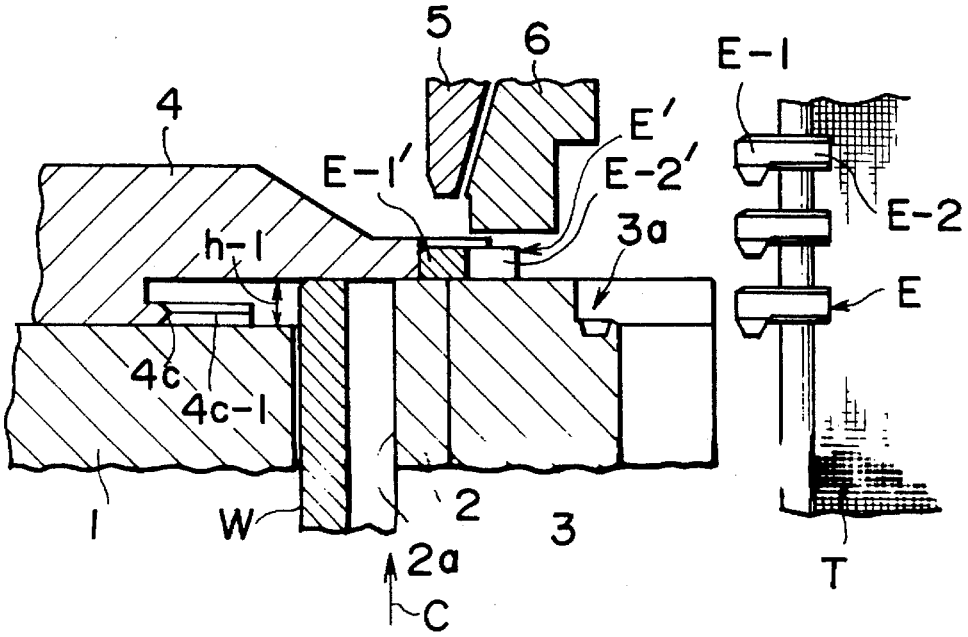
FIG. 3 is a vertical cross-sectional view showing the positional relationship between the components when a metal wire is sliced off.
Figure 4:
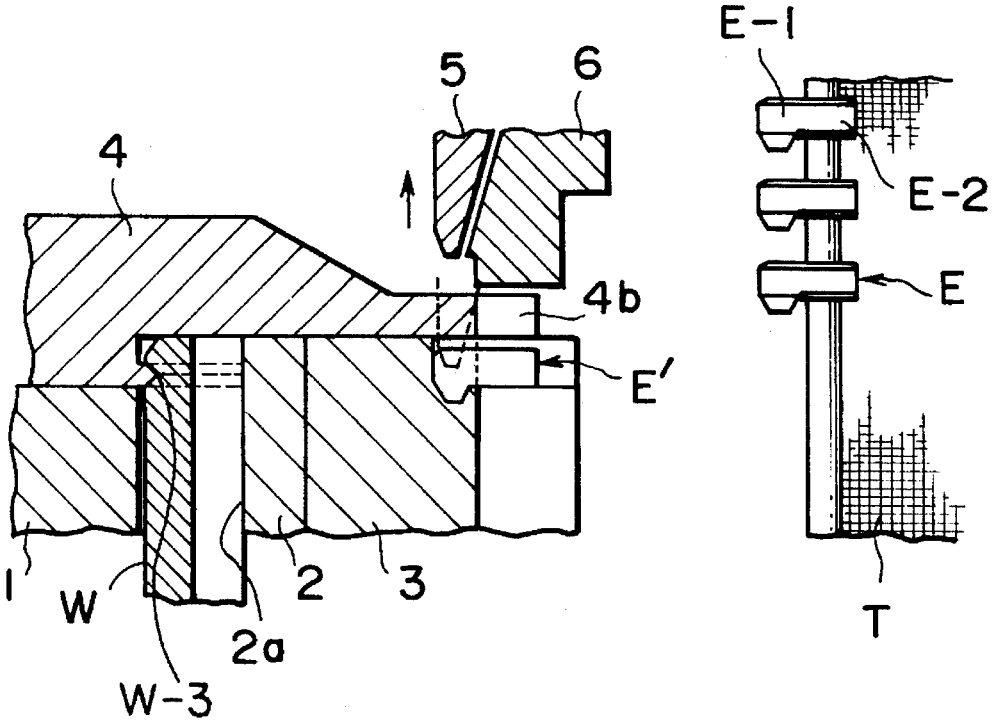
FIG. 4 is a vertical cross-sectional view showing the positional relationship between the components when the ram is in its fully retracted position.

A cutoff punch 4 is fixedly mounted oil the frame (not shown) and has a slide portion 4*a* slidably fitted in the recessed slide guide portion la in the ram 1. The underside of the cutoff punch 4 is offset to form a cutting edge 4*b* which extends forwardly from a front end of the cutoff punch 4 and which is vertically spaced from the top surface of the ram 1 by a distance h-1 (FIGS. 2 and 3). The cutting edge 4*b* is substantially complementary in shape with the contour of the Y-shaped metal wire W so as to embrace the latter from the opposite sides thereof. On the front side of the cutoff punch 4 there are disposed a pocket-forming punch 5 for shaping the head portion E-1' of a sliced blank piece E' (FIG. 3) into a coupling head E-1 (FIG. 4) of a finished coupling element E, and a presser pad 6 for forcing the leg portions E-2' (FIG. 3) of the sliced blank piece E' against the head-forming die 3 while the head portion E-I' is shaped. The pocket-forming punch 5 and the presser pad 6 vertically reciprocate and are mounted on a punch holder (not shown) secured to the frame. The pocket-forming punch 5 is disposed on a head-forming position or station of the apparatus. The vertical distance h-1 between the cutting edge 4*b* and the top surface of the ram 1 is determined such that when the slide portion 4*a* of the cutoff punch 4 is fitted in the recessed slide guide portion 1*a* of the ram 1 as shown in FIGS. 2–4, the cutting edge 4*b* of the cutoff punch 4 is relatively slidable on the top surface of the cutoff die 2.

As shown in FIG. 1, the cutoff punch 4 further has a chamfering blade 4*c* projecting from the front end face of the slide portion 4*a*. The chamfering blade 4*c* is complementary in shape with the contour of a corresponding portion of the Y-shaped metal wire W defined by the peripheral surface of the head portion W-1 and the outside surfaces of the respective leg portions W-2 and a contour inside of the chamfering edge is slightly smaller than the contour of the metal wire. The chamfering edge 4c-1 has a substantially equilateral triangular shape in cross section, as shown in FIGS. 2–4. The tip end of the triangular chamfering edge 4c-1 and the top surface of the cutting edge 2*b* of the cutoff die 2 are vertically spaced by a distance h-2 (FIG. 2) which is equal to the thickness of a finished coupling element E. The thus profiled chamfering edge 4c-1 bites into the outer peripheral surface of the Y-shaped metal wire W except the front end surfaces of the respective leg portions W-2, as a manner described below.

The apparatus of the foregoing construction operates as follows.

The Y-shaped metal wire W is intermittently fed by the feed means F in a vertically upward direction along the wire guide groove 2*a* in the cutoff die 2 so as to advance by a distance equal to the thickness of a finished coupling element E. While the metal wire W is at rest, the ram 1 is moved from the fully advanced position (FIG. 1) to the fully retracted position (FIG. 4). During that time, the cutting edge 2*b* of the cutoff die 2 moves across the cutting edge 4*b* of the cutoff punch 4, thereby cutting or slicing off a blank piece E' of an individual product thickness h-2 from the Y-shaped metal wire W, as shown in FIG. 3. As the ram 1 is further retracted, the cutoff die 2 forces the metal wire W against the chamfering edge 4c-1 of the chamfering blade 4*c*. A continued retracting movement of the ram 1 and the cutoff die causes the chamfering edge 4c-1 to bite into the peripheral surface of the head portion W-1 and the outside surfaces of the respective leg portions W-2.

When the ram 1 is moved to its fully retracted position shown in FIG. 4, the chamfering edge 4c-1 forms a V-shaped groove W-3 extending transversely through the outer peripheral surface of the Y-shaped metal wire W except the front end surfaces of the leg portions W-2. Since the chamfering edge 4c-1 is spaced vertically downwardly from the cutting edge 2*b* of the cutoff die 2 by the distance h-2 equal to the thickness of the finished coupling element E, a line of the peak of the V-shaped groove W-3 thus formed in the metal wire W will lie in the same plane as a cutting line when the next cycle is achieved to slice off the next blank piece E' from the metal wire W. On the other hand, the sliced blank piece E' while being held in the cutting edge 4*b* of the cutoff punch 4 is transferred into the head-forming cavity 3*a* in the head-forming die 3. Then, a pocket-forming punch 5 and the associated presser pad 6 are advanced downwardly toward the head-forming die 3 to stamp the head portion E-I' of the sliced blank piece E' with the pocket-forming punch 5, while holding the leg portions E-2' against displacement by the presser pad 6. Thus, the material of the head portion E-I' is forced by the pocket-forming punch 5 to flow into the head-forming cavity 3*a* with the result that the head portion E-I' is shaped into a coupling head E-1 (FIG. 4) having, on its opposite sides, a protrusion and a corresponding pocket. Thus, the blank piece E' (FIG. 3) is shaped into a finished coupling element E (FIG. 4).

Thereafter, the pocket-forming punch 5 and the presser pad 6 are retracted upwardly, after which the ram 1 (cutoff die 2) is advanced such that the finished coupling element E supported in the head-forming cavity 3a in the head-forming die 3 is placed in a clamping station where a fastener tape T is supported in a vertical orientation. The clamping station includes a clincher composed of a pair of side punches 7 (FIG. 1) disposed on opposite sides of a longitudinal beaded edge of the fastener tape T. When the finished slide fastener E arrives at the clamping station, the side punches of the clincher are driven toward each other to clamp the legs E-2 of the finished coupling element E on the longitudinal beaded edge of the fastener tape T. The fastener tape T is then pulled upwardly by a predetermined pitch. Thus, the finished coupling elements E are attached one by one to the fastener tape T to complete a single slide fastener stringer S. The fastener tape T is supplied from a lower portion of the apparatus and intermittently fed in a vertically upward direction while being guided by a tape guide (not shown).

As the ram 1 advances, the metal wire W is separated from the chamfering blade 4*c* of the cutoff punch 4. When the ram 1 arrives at its fully advanced position, or preferably immediately before the ram 1 arrives at the fully advanced position, the metal wire W is fed upwardly by a distance h-2 so that the thickness of a portion of the metal wire W projecting from the top surface of the cutoff die 2 is equal to the thickness of the next blank piece E' to be sliced off from the metal wire W. With this upward feed of the metal wire W, the V-shaped groove W-3, formed in the metal wire W by the chamfering edge 4c-1 of the chamfering blade 4*c*, lies flush width the top surface of the cutoff die 2, as shown in FIG. 2.

Then, the ram 1 is retracted again, whereupon the cutting edge 2*b* of the cutoff die 2 and the cutting edge 4*b* of the cutoff punch 4 co-act to cut or slice the metal wire W along the V-shaped groove W-3, thereby producing the next blank piece E' (FIG. 3). The blank piece E' thus produced automatically chamfered or beveled at its upper and lower peripheral edges extending along the peripheral surface of head portion E-1' and the outside surfaces the respective leg portions E-2'. Then, the pocket-forming punch 5 and the presser pad 6 are driven again to shape the head portion E-1' of the blank piece E' into a coupling head E-1 of a finished coupling element E. The finished coupling element E is subsequently clamped to the longitudinal beaded edge of the fastener tape T. The foregoing sequence of operations is repeated until a continuous slide fastener stringer S of a desired length is produced. All the movable parts of the apparatus are operated in timed relation to one another.

In the embodiment described above, the invention is applied to an apparatus which is constructed to shape a slide-fastener coupling element from a metal wire and subsequently attach the finished coupling element to the fastener tape. The present invention is also applicable to an apparatus which is used exclusively for the shaping of a slide-fastener coupling element. In the latter-mentioned apparatus, the finished coupling elements are collected and discharged from the apparatus for an additional finishing process such as polishing or plating.

The chamfering means used in the embodiment previously described comprises a one-piece chamfering blade 4 having a continuous chamfering edge 4c-1. The disclosed chamfering means should be construed as illustrative rather than restrictive. Though not shown, the one-piece chamfering blade 4*c* may be replaced by a two-piece chamfering blade composed a head-chamfering blade member and a leg-chamfering blade member that are movable independently from one another. In this instance, the head-chamfering blade member is formed integrally with the cutoff punch 4 and has a substantially arcuate chamfering edge engageable with the peripheral surface of the head portion W-1 of the metal wire W. On the other hand, the leg-chamfering blade member is composed of two confronting blade pieces relatively movably mounted on the cutoff punch 4 and having opposed chamfering edges each engageable with the outside surface of one leg portion E-2 of the metal wire W. The blade pieces are normally urged away from each other. To move the blade pieces toward each other, the ram 1 has a pair of cam surfaces formed on opposite side walls of the recessed slide guide portion 1*a*. During a final part of the retracting stroke of the ram 1, the cam surfaces engage the corresponding blade pieces and then urge them toward each other.

It is apparent from the foregoing description that the present invention is embodied in a method and apparatus of the type in which slide-fastener coupling elements are produced by press-forming from a continuous metal wire with a high productive efficiency. Due to the substantially V-shaped groove formed in the metal wire along a next cutting line, the next blank piece sliced from the metal wire is already beveled at its upper and lower outer peripheral edges extending along the peripheral surface of the head portion and the outside surfaces of the respective leg portions. A finished coupling element formed from the thus chamfered blank piece is smooth to touch and ensures smooth sliding movement of the slider which eventually guarantees smooth opening and closing operation of the slide fastener.

Obviously, various minor changes and modifications of the present invention are possible in the light of the above teaching. It is therefore to be understood that within the scope of the appended claims the invention may be practiced otherwise than as specifically described.

What is claimed is:

1. A method of forming a slide-fastener coupling element, of the type in which a continuous metal wire having a substantially Y-shaped cross section including a head portion and a pair of leg portions is intermittently fed in a vertically upward direction through a cutoff die at a predetermined pitch, then the metal wire is cut into a blank piece of an individual product thickness by a co-action between a cutting edge formed at a rear end of the cutoff die reciprocally movable rearwards and forwards by a ram and a cutting edge of a fixed cutoff punch relatively slidable on the reciprocating cutoff die, and thereafter a head portion of the blank piece is shaped into a coupling head by a co-action between a head-forming die attached to a front end of the cutoff die and a pocket-forming punch disposed above a head-forming position and vertically reciprocally movable toward and away from the head-forming die in synchronism with the reciprocating movement of the head-forming die, wherein the improvement comprises:

substantially at the same time one blank piece is cut off from the metal wire, chamfering the metal wire along a next cutting line to form a substantially V-shaped groove extending in and along the peripheral surface of the head portion and the outside surface of each of the leg portions of the metal wire.

2. A method according to claim 1, wherein said chamfering includes forcing the metal wire against a chamfering edge of the cutoff punch via the reciprocating movement of the cutoff die, said chamfering edge being vertically and downwardly spaced from said top surface of said cutoff die by a distance equal to said thickness of the sliced blank piece, said chamfering edge having a substantially equilateral triangular cross section and being complementary in shape with the contour of a corresponding portion of the metal wire defined by the peripheral surface of the head portion and the outside surface of each of the leg portions of the metal wire and a contour defined inside the chamfering edge is slightly smaller in size than the contour of the metal wire.

3. An apparatus for forming a slide-fastener coupling element having a coupling head and a pair of legs, of the type including means for intermittently feeding a continuous metal wire having a substantially Y-shaped cross section including a head portion and a pair of leg portions in a vertically upward direction at a predetermined pitch, a horizontally reciprocating ram, a cutoff die having a vertical guide groove for the passage therethrough of the metal wire and driven by said ram to reciprocate across the passage of the metal wire, a head-forming die attached to a front end of said cutoff die, a fixed cutoff punch having a cutoff edge formed at a front end thereof and relatively slidable on a top surface of said cutoff die to cut off a blank piece from the metal wire, and a pocket-forming punch disposed on a head-forming position and vertically reciprocally movable in synchronism with the reciprocating movement of said head-forming die so as to shape a head portion of the sliced blank piece into a coupling head of a finished coupling element, wherein the improvement comprises:

a chamfering blade provided on said cutoff punch and having a chamfering edge horizontally and rearwardly spaced from said cutting edge of said cutoff punch, said chamfering edge being vertically and downwardly spaced from said top surface of said cutoff die by a distance equal to said thickness of the sliced blank piece, said chamfering edge having a substantially equilateral triangular cross section and being complementary in shape with the contour of a corresponding portion of the metal wire defined by the peripheral surface of the head portion and the outside surface of each of the leg portions of the metal wire, a contour defining the chamfering edge being slightly smaller in size than the contour of the metal wire.

* * * * *